United States Patent [19]

Saulson

[11] 4,006,512

[45] Feb. 8, 1977

[54] MAGNETIC BUMPER AND PICKUP DEVICE

[76] Inventor: Saul S. Saulson, 31477 Lost Hollow Lane, Birmingham, Mich. 48010

[22] Filed: Jan. 7, 1976

[21] Appl. No.: 647,075

Related U.S. Application Data

[63] Continuation of Ser. No. 487,856, July 12, 1974, abandoned.

[52] U.S. Cl. ..... 15/339; 209/215

[51] Int. Cl.[2] ..... A47L 9/00

[58] Field of Search ..... 15/105, 220 A, 339; 209/215

[56] References Cited

UNITED STATES PATENTS

| | | | |
|---|---|---|---|
| 2,253,362 | 8/1941 | Broekhuysen | 209/215 |
| 2,288,115 | 6/1942 | Soldanels | 15/415 X |
| 2,677,461 | 5/1954 | Bodey | 15/339 X |
| 2,847,084 | 8/1958 | Wolfskill et al. | 15/339 X |
| 2,862,224 | 12/1958 | Swanson et al. | 15/339 X |
| 3,206,783 | 9/1965 | Schwartz | 15/105 |
| 3,646,492 | 2/1972 | Westermann | 209/215 X |
| 3,751,750 | 8/1973 | Kaftan | 15/220 A |

*Primary Examiner*—Christopher K. Moore
*Attorney, Agent, or Firm*—Krass & Young

[57] ABSTRACT

A bumper and magnetic pickup device for vacuum sweepers includes a strip of magnetized elastomer having magnetic poles aligned along its opposite longitudinal edges and supported on a metal strip. The metal strip is bent at each end to form brackets which mount on the front end of the sweeper, creating a space between the bumper and the sweeper for magnetizable objects to collect without entering the nozzle of the vacuum sweeper.

2 Claims, 4 Drawing Figures

FIG. 1
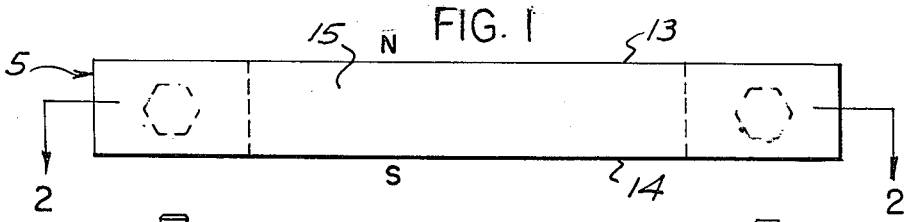
FIG. 2
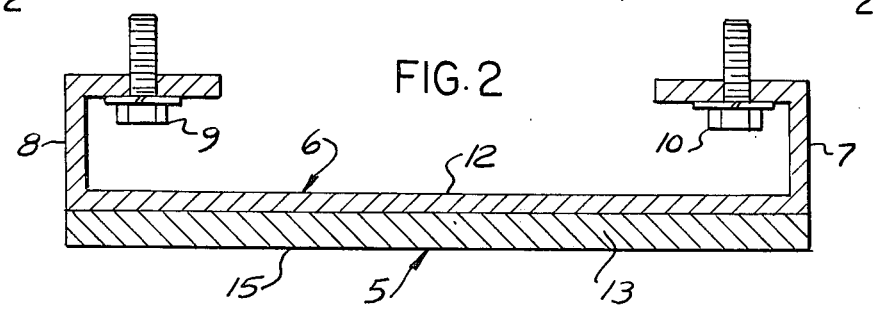
FIG. 4
FIG. 3
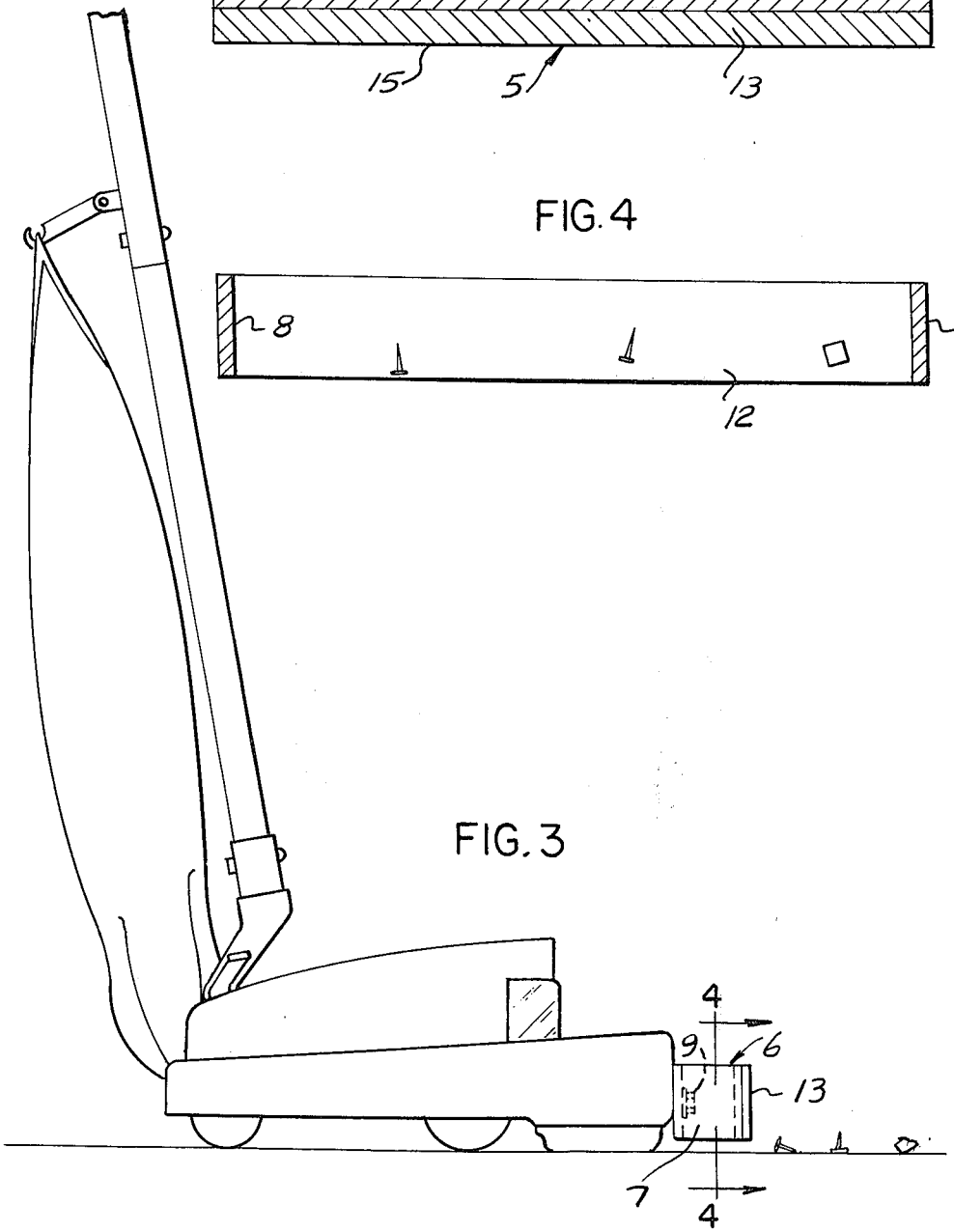

MAGNETIC BUMPER AND PICKUP DEVICE

This is a continuation of application Ser. No. 487,856, filed July 12, 1974, and now abandoned.

FIELD OF THE INVENTION

The invention relates to magnetic pickup and bumper devices for vacuum sweepers.

BACKGROUND OF THE INVENTION

Wherever vacuum sweepers are used, especially in commercial applications, there exists the problem of preventing small metallic objects from entering the machine and having a detrimental effect on its operation. Previous attempts to solve this problem utilized a front end magnetic pickup attachment which, though somewhat successful, provided no means of preventing accumulated particles from breaking loose from the magnet and being drawn into the sweeper by its forward motion. An example of this type of arrangement is disclosed in Soldanels U.S. Pat. No. 2,288,115. Bodey U.S. Pat. No. 2,677,461 attempted to overcome this particular drawback by providing a "ledge", which partially extended under the magnetic element, where magnetic particles could collect. However, due to the design of the pickup device, with the magnetic collecting surface on the bottom face of the unit, accumulations of metallic particles would still cause difficulties by either blocking the nozzle entrance or allowing the excess particles to escape. The present invention contemplates a simple, effective and inexpensive means of solving these problems.

SUMMARY OF THE INVENTION

The present invention employs a strip of magnetized elastomer mounted on one side to a supporting metal strip. The strip of elastomer is doped with metallic particles which are permanently magnetized in a manner creating opposite poles along the longitudinal edges of the elastomeric strip. The strip of magnetized elastomer thus acts both as bumper and pickup device. The metallic support strip is constructed of a magnetizable metal, preferably steel, so that it will become magnetized in the same manner when affixed to the strip of elastomer. In the preferred embodiment of the invention the ends of the support strip are bent to form mounting brackets which space the bumper unit from the front end of the vacuum sweeper when the unit is fastened thereto. Thus, when metallic objects are encountered during the normal forward operation of the vacuum sweeper, some will immediately attach to the front surface of the bumper while others will be attracted to the bottom edge of the unit, where accumulated objects will ultimately be drawn to the backside of the magnetic bumper away from the nozzle of the sweeper. The vertical magnetic field created between the top and bottom edges of the bumper unit will cause relatively long objects to be vertically aligned along the backside of the bumper unit rather than along the bottom edge.

Other objectives, advantages and applications of the invention will be made apparent by the following detailed description of a preferred embodiment of the invention. The description makes reference to the accompanying drawings in which:

FIG. 1 is a front view of the bumper unit;

FIG. 2 is the top view of the bumper unit as described in the preferred embodiment;

FIG. 3 is a perspective view of the bumper unit attached to a vacuum sweeper; and FIG. 4 is a rear view of the bumper taken along line 4—4 of FIG. 3.

PREFERRED EMBODIMENT OF THE INVENTION

Referring to the drawings, the magnetic bumper unit constituting the preferred embodiment of the invention, generally indicated at 11 in FIG. 3, is intended for use on commercial vacuum sweepers, though its use is not limited to such sweepers. The front of the unit, as shown in FIGS. 1 and 2, consists of a strip of magnetized elastomer 5 equivalent in length to the width of the front end of the vacuum sweeper, and of sufficient width and thickness to provide an adequate bumper surface, typically an inch by one-quarter of an inch, respectively.

The elastomeric material is doped with metallic particles which are readily magnetizable, thus giving the entire elastomeric material its magnetic properties. In the preferred embodiment of the invention, a material manufactured by the Minnesota Mining & Manufacturing Company under the brand name "Plastiform", consisting of a rubber strip impregnated with barrium ferride particles, has been found to be effective in producing the desired characteristics. It is recognized, however, that other materials possessing similar properties could adequately be employed.

The elastomeric strip is permanently magnetized in a bipolar fashion so that opposite poles run along the longitudinal edges of the strip 13 and 14 (FIG. 1) creating magnetic lines of force at right angles to its length. During normal operation of the vacuum sweeper, encountered metallic objects will initially attach to the front surface 15 and the bottom edge 14 of the bumper unit. However, due to this particular pole configuration, as increasing amounts of objects accumulate on the bottom edge of the unit 14, the continued forward motion of the vacuum sweeper will tend to cause excessive accumulations to be drawn to the backside of the bumper unit 12, away from the front end and nozzle of the sweeper.

Bonded to one side of the strip of elastomer 5 is a rigid, magnetizable, metallic strip 6, preferably steel, of equal width. The steel strip should be of sufficient thickness to provide adequate support for the magnetized rubber bumper, typically one-eighth of an inch. The ends of the steel strip 6 are shaped to form "U" brackets 7 and 8, as shown in FIG. 2, such that the resulting length of the supporting surface of the steel strip is equivalent to that of the strip of magnetized elastomer 5. The U-shaped brackets 7 and 8 are formed so as to create a space, when the unit is mounted, between the front end of the sweeper and the backside of the steel bumper support 12, where magnetizable objects can collect without being drawn into the sweeper.

The unit is fastened to the front end of the vacuum sweeper by two bolts 9 and 10, one through each U bracket, as shown in FIG. 3, with the rubber bumper surface 15 facing away from the sweeper. When mounted, the bottom longitudinal edge of the bumper unit 14 should be sufficiently close and parallel to the floor to allow for the proper operation of the magnetic pickup without at the same time blocking non-metallic matter from entering the nozzle of the sweeper.

Having thus described my invention, I claim:

1. The combination of a vacuum sweeper and a magnetic pickup and bumper device comprising a strip of magnetized rubber of length equivalent to the width of the front end of the vacuum sweeper, said strip being permanently magnetized in a bipolar fashion so as to create opposing magnetic poles along the opposite longitudinal edges of said rubber strip; said rubber strip being bonded to and supported on one side of a strip of steel of equal width to induce a magnetic field in the steel strip; said steel strip having a U-shaped mounting bracket formed at each end so that the length of the bonded surface of the steel strip is equivalent to the length of said rubber strip; said steel strip being fastened to the lower forward end of the vacuum sweeper by said mounting brackets so as to create a space between the backside of said steel strip and the forward end of said sweeper; said rubber strip facing outwardly from said sweeper with its length being parallel, and its width perpendicular to the surface of the floor supporting said vacuum sweeper whereby the rubberized strip precedes the sweeper upon forward motion of the sweeper to act as a resilient bumper and ferrous objects attracted to the device will become lodged on the backside of the steel strip with their elongate axes vertically aligned, out of the pickup range of the sweeper.

2. The magnetic pickup and bumper device of claim 1 wherein said rubber is doped with barium ferrite particles.

* * * * *